US005317906A

United States Patent [19]

Dolan et al.

[11] Patent Number: 5,317,906

[45] Date of Patent: Jun. 7, 1994

[54] REFRIGERANT CONFIGURATION SYSTEM

[75] Inventors: Robert P. Dolan, Syracuse; Thomas L. DeWolf, Liverpool; Thomas R. Phillips, Cicero; Victor C. Edozien, Syracuse, all of N.Y.

[73] Assignee: Carrier Corporation, Syracuse, N.Y.

[21] Appl. No.: 55,098

[22] Filed: May 3, 1993

[51] Int. Cl.[5] ..... F25B 49/00

[52] U.S. Cl. ..... 62/127; 62/149

[58] Field of Search ..... 62/125, 126, 127, 129, 62/149, 292, 298, 77; 236/94

[56] References Cited

U.S. PATENT DOCUMENTS 4,795,088 1/1989 Kobayashi et al. ..... 62/298 X 5,243,828 9/1993 Paige et al. ..... 62/149 X

*Primary Examiner*—Harry B. Tanner

[57] ABSTRACT

System and process are disclosed for selecting a range or configuration of refrigerants that may thereafter be used by a refrigerant recovery system in the recovery of one or more of the refrigerants. The recovery of refrigerants may occur at anytime after a range has been selected including a time during which the refrigerant recovery system has been switched off and back on again.

16 Claims, 4 Drawing Sheets

| | |
|---|---|
| CNFG = 1 | R12, R22, R500, R502 |
| CNFG = 2 | R12, R22, R500, R502, R134a |
| CNFG = 3 | R134a |

REFRIGERANT CONFIGURATION SYSTEM

BACKGROUND OF THE INVENTION

This invention relates to the recovery of refrigerants from air conditioning systems. In particular, this invention relates to the manner in which an electronic display and control system can be used to define which of a number of different refrigerants can be selected for possible recovery from air conditioning systems.

The recovery of refrigerants from air conditioning and refrigeration systems has become increasingly important from both an environmental and an economic standpoint. A recovered refrigerant prevents unnecessary release of chlorofluorohydrocarbons into the atmosphere and a properly recycled refrigerant allows for the continued cost effective use of the same refrigerant. To this end, various systems have been designed to recover specific refrigerants. These systems have usually concentrated on recovering refrigerant from a given range of refrigerants. These systems cannot easily switch to a different range of refrigerants which may need to be individually recovered.

OBJECTS OF THE INVENTION

It is an object of the invention to provide refrigerant recovery apparatus that is adaptable to the recovery of a number of different ranges of refrigerants.

SUMMARY OF THE INVENTION

The above and other objects of the invention are achieved by an electronic control and display system that can be configured in a number of different ways so as to define the recovery of different ranges of refrigerants. The system includes a keypad that may be operated in conjunction with a system display to successively step through a number of different control configurations that define different ranges of refrigerants. Each depression of the keypad causes a different control configuration to be displayed.

Election of a particular control configuration occurs when certain keys on the keypad are depressed in a certain manner. The elected control configuration is stored in nonvolatile memory for recall by the system any time the system is to be used for refrigerant recovery. This includes switching the power to the entire system off when it is not being used. When power is again switched on, the elected configuration stored in nonvolatile memory is again available for use by the refrigerant recovery system.

BRIEF DESCRIPTION OF THE DRAWINGS

Other objects and advantages of the present invention will be apparent from the following description in conjunction with the accompanying drawings in which.

DESCRIPTION OF THE PREFERRED EMBODIMENT

Figure 1:
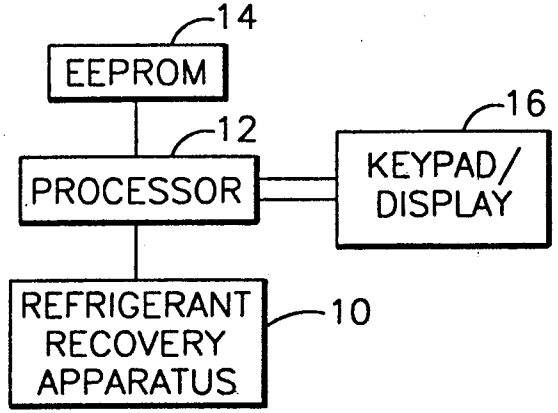
FIG. 1 illustrates a refrigerant recovery system including a programmable microprocessor interfacing with nonvolatile memory and a keypad/display apparatus.

Referring to FIG. 1, a refrigerant recovery system is seen to include refrigerant recovery apparatus 10 controlled by a microprocessor 12. The recovery apparatus will include circuitry responsive to control signals from the microprocessor 12 for implementing an automatic refrigerant recovery. This circuitry will include well known control functions for selectively admitting refrigerant to the recovery portion of the recovery apparatus. Various control parameters defining these control functions for each particular refrigerant are stored for use by the microprocessor 12. These control parameters are then used by the microprocessor 12 to control the recovery apparatus 10 when a particular refrigerant is to be recovered.

Figure 2:
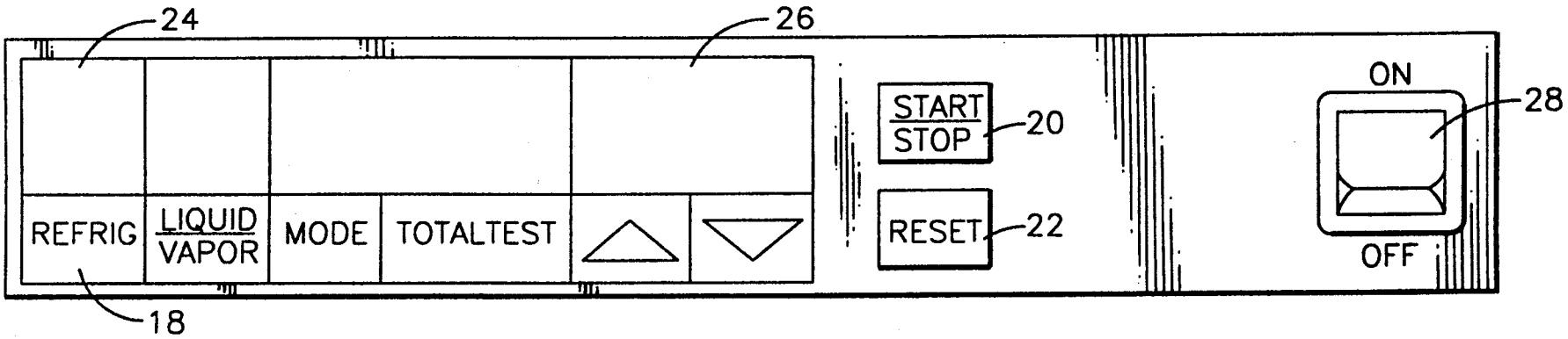
FIG. 2 illustrates the keypad/display apparatus of FIG. 1.

The microprocessor 12 interfaces with a nonvolatile memory 14 that is preferably an electrically erasable programmable read and write memory. The microprocessor also interfaces with a keypad/display 16. The keypad/display 16 is shown in further detail in FIG. 2. Referring to FIG. 2, a keypad portion of the keypad/display 16 is seen to include a touch sensitive keypad switch 18 denoted as "REFRIG", a "START/STOP" keypad switch 20 and a "RESET" keypad switch 22. The display portion of the keypad/display 16 includes a liquid crystal display portion 24 above the REFRIG keypad switch 18 and a further liquid crystal display portion 26 adjacent the keypad switches 20 and 22. The keypad/display 16 also includes a power switch 28 which switches the AC power on or off to the microprocessor 12 and the recovery apparatus 10.

The microprocessor 12 contains a configuration selection process which when activated by simultaneous depression of the REFRIG switch 18 and the RESET switch 22 causes the display of a configuration mode in the display 26. Various ranges of refrigerants are thereafter displayed in the display portion 24 of the keypad/display apparatus by depressing the REFRIG switch 22. A particular range or configuration is selected by depression of the START/STOP switch 20.

Figure 3A:
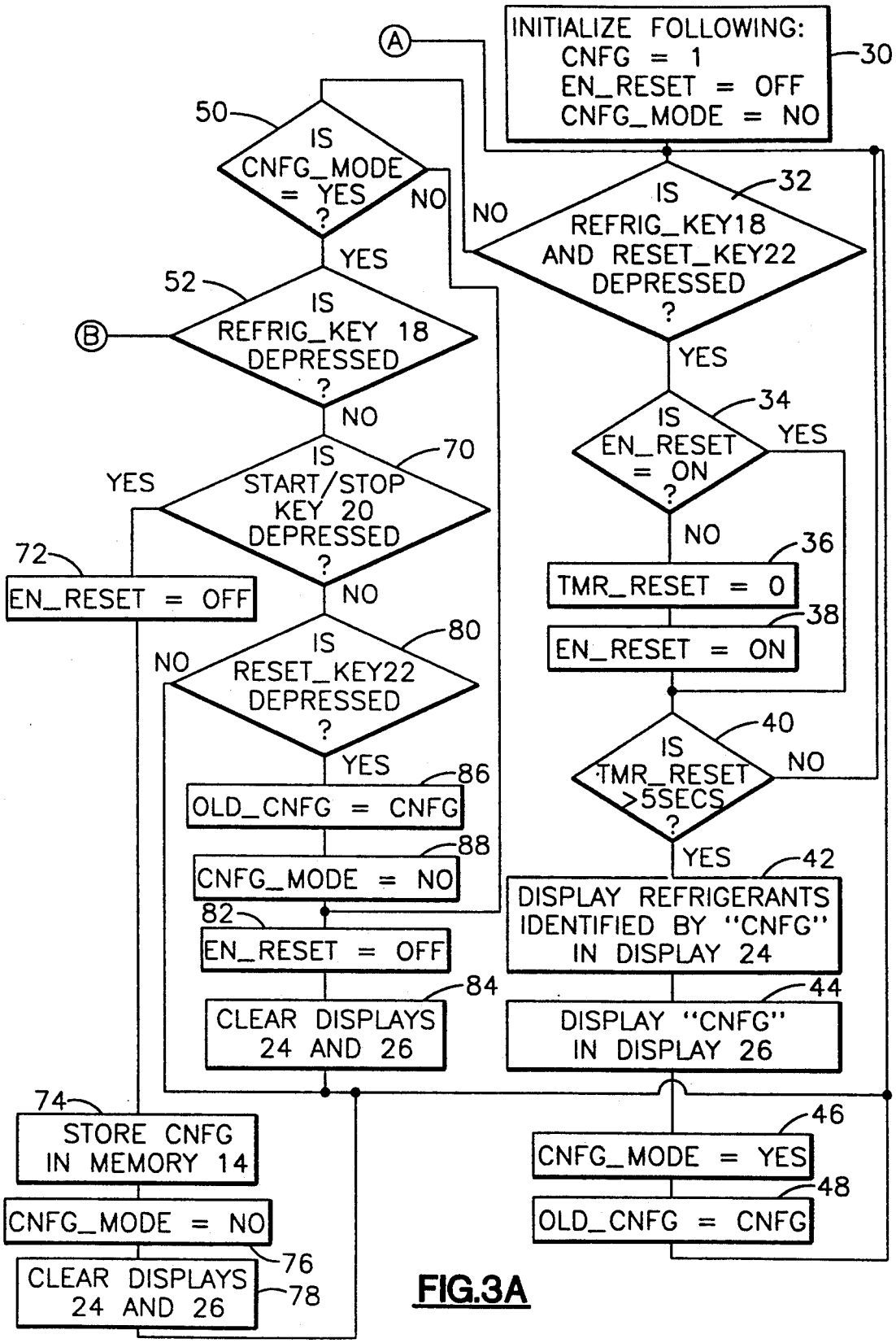
FIGS. 3A and 3B illustrate a program within the microprocessor which allows a particular configuration of refrigerants to be selected for recovery by the system.
Figure 3B:
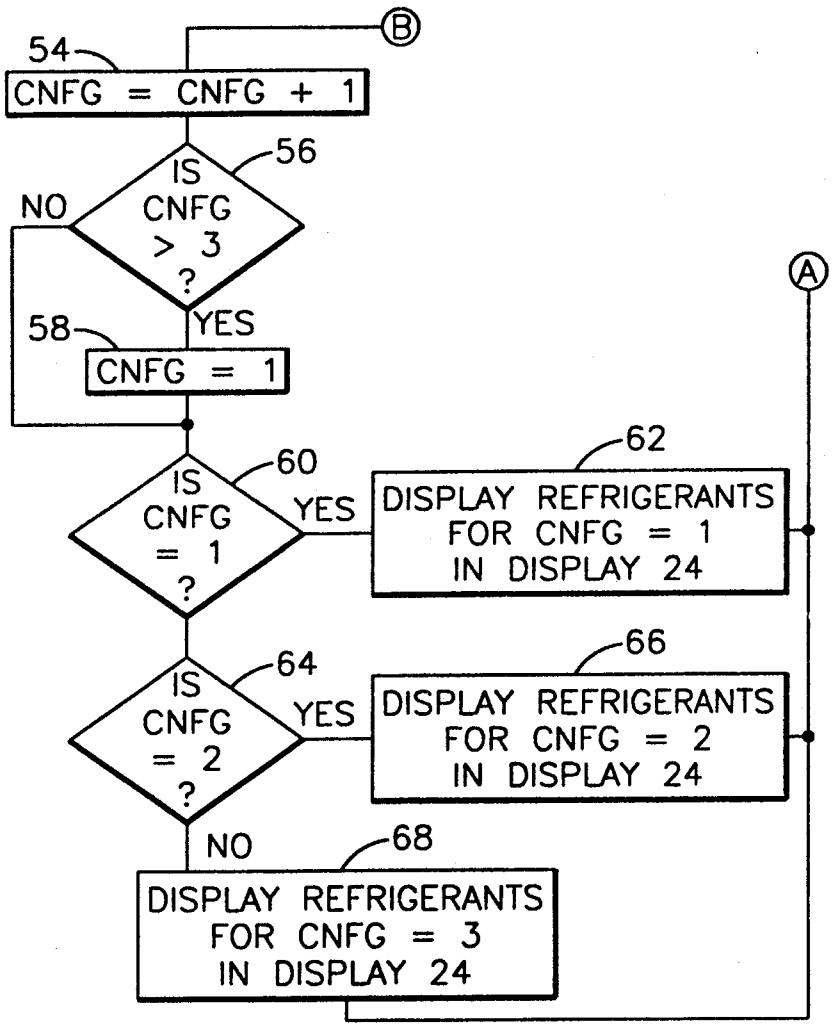

Referring to FIGS. 3A and 3B, the software within the microprocessor 12 which performs the aforementioned configuration process is shown in detail. This software begins with a step 30 wherein certain software variables are initialized prior to execution of the configuration selection process. A configuration variable CNFG is set equal to one. The value of this variable identifies which particular configuration of refrigerants will be displayed in the display area 24. In this regard, each configuration will include a unique combination of refrigerants that may be selected by the configuration selection process. In the preferred embodiment, there are three separate configurations. Configuration one includes the refrigerants R12, R22, R500, and R502. Configuration two consists of the refrigerants R12, R22, R500, R502 and R134*a*. Configuration three is only the refrigerant R134*a*. Another variable to be initialized in step 30 is EN_RESET. This variable is set equal to "off" initially. Finally a configuration mode variable, CNFG_MODE, is set equal to "no". Upon initializing the above variables, the microprocessor proceeds to a step 32 and inquires whether the REFRIG key 18 and the RESET key 22 are both depressed. If the answer is yes, the microprocessor proceeds to a step 34 and inquires whether the enable reset variable, EN_RESET is equal to on. Since this variable is initially off, the microprocessor will proceed to a step 36 and set a timer reset variable, TMR_RESET, equal to zero and thereafter in a step 38 set the variable, EN_RESET, equal to "on". This enables TMR_RESET. TMR_RESET is a software clock which begins counting in time increments that can be measured in seconds when EN_RESET equals "on". This time is checked in step 40 for being greater than five seconds. In the event that the reset timer has not yet exceeded five seconds, the microprocessor returns to step 32 and again inquires as to the status of the refrigeration key 18 and the RESET key 22. It is to be appreciated that if these keys continue to be depressed for five seconds, the microprocessor will exit from step 40 to a step 42 and cause the refrigerants identified by the configuration variable CNFG to be displayed in the display area 24 of the keypad/display 16. Since the configuration variable is initially set equal to one, the refrigerants corresponding to this particular configuration will be displayed. The microprocessor will immediately proceed to a step 44 and display the letters "CNFG" in the display 26. At this point the user or operator of the keypad/display 16 of FIG. 2 will have been placed on notice that the microprocessor 12 is in the configuration selection mode and that the currently selected configuration of refrigerants is that displayed in the display 24. Referring again to FIG. 3, upon displaying the letters "CNFG", the microprocessor will proceed to a step 46 and set the configuration mode variable, CNFG_MODE equal to yes. The microprocessor will next proceed in a step 48 to set a variable, OLD_CNFG equal to the current value of the variable CNFG. Upon exiting step 48, the microprocessor will immediately loop back to step 32 and inquire as to whether the REFRIG key 18 and the RESET key 22 are still both depressed. The user or operator of the keypad/display 16 should at some point release the RESET key 22 as a result of having seen the display of the letters "CNFG" in the display 26. When this occurs, the microprocessor will proceed along the "no" path out of the step 32 to a step 50. Referring to step 50, the inquiry is made as to whether the configuration mode variable, CNFG_MODE, is equal to yes. Since this variable will have been set equal to yes in step 46, the microprocessor will proceed to a step 52 and inquire as to whether the REFRIG key 18 is depressed. The REFRIG key 18 will be depressed if the operator wishes to possibly reset the system to a different configuration of refrigerants than what is currently displayed in the display 24.

In this event, the microprocessor will proceed a step 54 in FIG. 3B. Referring to step 54, the configuration variable, CNFG, is incremented by one in response to the refrigeration key 18 being depressed. Since CNFG is initially one, the new CNFG value will be equal to two. The microprocessor proceeds to inquire as to whether the thus incremented configuration variable is greater than three in a step 56. It is to be noted that if CNFG were calculated to be four in step 54, than, the configuration variable would be reset equal to one in a step 58. The thus denoted value of the configuration variable is examined in step 60 for being equal to one. In the event that the configuration variable were equal to one, the microprocessor would proceed to a step 62 and display the refrigerants corresponding to this configuration value in display 24. Since the configuration variable is not equal to one, the microprocessor will proceed to a step 64 and examine CNFG for being equal to two. Since CNFG is equal to two, the microprocessor will proceed to a step 66 and display the refrigerants corresponding to this configuration value. Referring to step 64, it is to be noted that if the configuration variable is not equal to two, then the display of refrigerants corresponding to CNFG equal to three will take place on display 24 in a step 68. Since the display will correspond to CNFG equal to two, the microprocessor will proceed from step 66 and return to the beginning of the program where it will again pass through steps 32 and 50 to step 52. In the event that the appropriate configuration has been displayed, the operator will have released the refrigerant key 18. This will cause the microprocessor to proceed to a step 70 and question whether the START/STOP key 20 has been depressed. When the START/STOP key 20 is depressed, the microprocessor will proceed to a step 72 and set the variable EN_RESET to an "off" status. The microprocessor will thereafter proceed in a step 74 to store the value of the configuration variable CNFG in the nonvolatile memory 14. The configuration mode variable, CNFG_MODE, will next be set equal to a "no" status in step 76 and the displays 24 and 26 will be cleared in a step 78. At this point, the operator or user of the keypad/display 16 will have been advised that the system is no longer in a configuration mode.

The microprocessor will loop back to the beginning of the program and again move through steps 32, 50, 52, and, hence to 70 in order to sense when the START/STOP key is no longer depressed. When this occurs, the microprocessor will proceed to examine whether the RESET key is depressed in a step 80. Normally the RESET key 22 will not be depressed. This will prompt the microprocessor to proceed out of step 80 along the "no" path where it will loop back to step 32 and hence to step 50. Since the configuration mode variable has now been set equal to "no" the microprocessor will proceed along the "no" path out of step 50 to a step 82 wherein the variable EN_RESET is set to "off". The displays 24 and 26 will be cleared in a step 84. The microprocessor will loop back to step 32 and continue to execute the loop down through steps 50, 82 and 84 until such time as CNFG_MODE is again equal to "yes".

It is to be appreciated that steps 82 and 84 are redundant in the particular sequence of events that have been heretofore described. In this regard, EN_RESET and the clearances of displays 24 and 29 were previously dealt with in steps 72 and 78. The reason for inclusion of steps 82 and 84 downstream of step 50 is to deal with a different set of events, namely, when the RESET key 18 and the REFRIG key 27 have not been depressed for the full five seconds. Under such circumstances the variable EN_RESET needs to be set off and the displays need to be cleared so that any subsequent depression of the REFRIG key 18 and RESET key 22 will require a five second clock count in steps 36 and 38.

It is also to be appreciated from the above explanation of the configuration selection process, that the entire process is initiated by depressing both the REFRIG key 18 and the RESET key 20. If these keys have been depressed for a total of five seconds, then the configuration mode is entered into and the program awaits the release of either or both keys in step 32. When either or both keys are no longer depressed, the microprocessor 12 will proceed to examine whether the REFRIG key is depressed in step 52. Depression of the REFRIG key 18 prompts successive displays of the various ranges of refrigerants until the REFRIG key 18 is released. The value of the configuration variable, CNFG, corresponding to the then displayed refrigerants is stored in the nonvolatile memory 14 when the START/STOP key 20 is depressed in step 70.

In the event that the REFRIG key 18 is never depressed following initiation of a configuration mode, the microprocessor may respond to either the START/-STOP key 20 being depressed or the RESET key 22 being depressed. Depression of the START/STOP key will simply again store the current value of CNFG in the nonvolatile memory 14. If on the other hand, the RESET key 80 is the only key to subsequently be depressed following initiation of the configuration mode, then the microprocessor proceeds to set CNFG equal to the value of OLD_CNFG in a step 86. The microprocessor thereafter sets the variable, CNFG_MODE, equal to "no" in step 88. The variable EN_RESET is set equal to off in step 82 and the displays 24 and 26 are cleared in step 84. In this manner, the program of FIG. 3 is permitted to exit from the configuration mode through depression of the RESET key 18 as opposed to depression of the START/STOP key 20.

Figure 4:
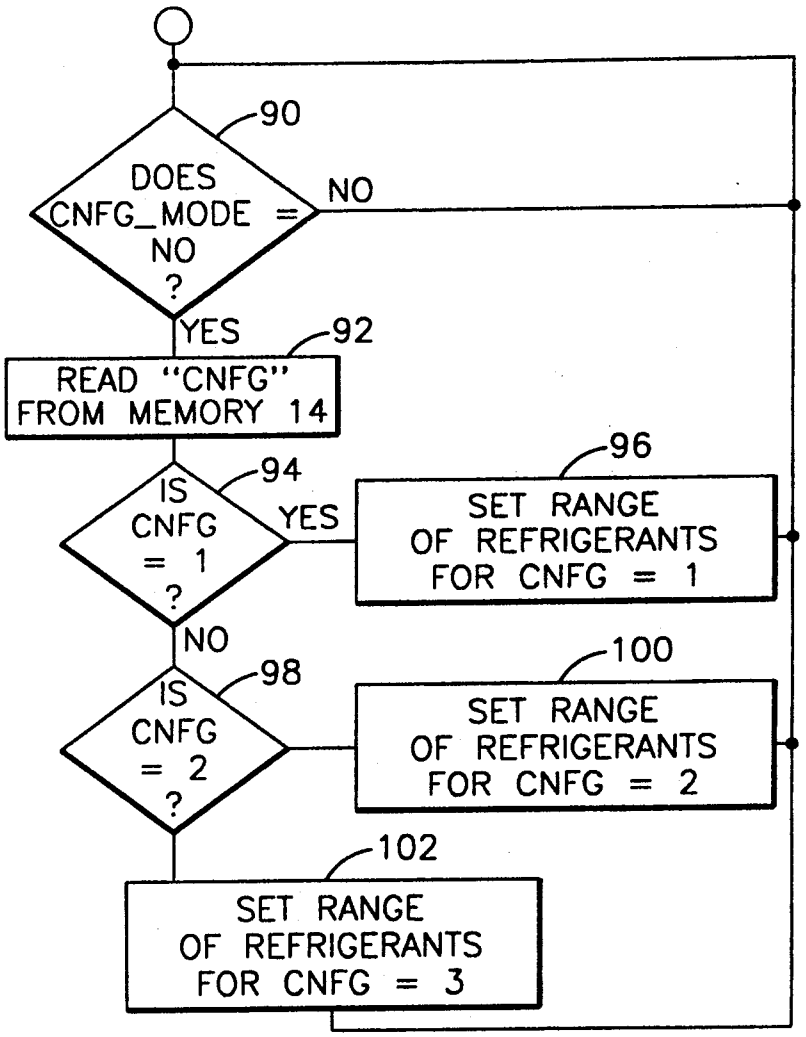
FIG. 4 illustrates a program within the microprocessor which establishes the range of refrigerants that correspond to the configuration of refrigerants selected by the program of FIG. 3.

Referring now to FIG. 4, the program which limits the range of refrigerants to the particular configuration of refrigerants previously selected in the program of FIG. 3 is illustrated. The program of FIG. 4 begins with a step 90 which inquires whether the configuration mode is equal to "no". The configuration mode will normally be off or in a "no" status except for those rare instances when the configuration selection software of FIG. 3 is activated by depression of the two keys 18 and 22. With the configuration selection mode normally off, the program of FIG. 4 will proceed to a step 92 and read the value of the configuration variable, CNFG, from the nonvolatile memory 14. If the value is one, then the microprocessor will exit out of a step 94 to a step 96 and establish the range of refrigerants corresponding to this value. This range of refrigerants will have been stored in a recallable table under the value of the configuration variable being one. This stored range will allow the ultimate selection of one refrigerant from within this range of refrigerant by a further program within the microprocessor 12. Referring again to step 94, in the event that the value of the configuration variable read from the nonvolatile memory 14 is not one, then the microprocessor will proceed to a step 98 and examine the read value for being equal to two. If it is equal to two, then the range of refrigerants corresponding to this numbered configuration is established in a step 100. This range of refrigerants is preferably stored in a recallable table under CNFG equal to two. In a similar manner, a third range of refrigerants is defined in a step 102 if the read configuration variable CNFG is equal to three.

Figures 5, 6:
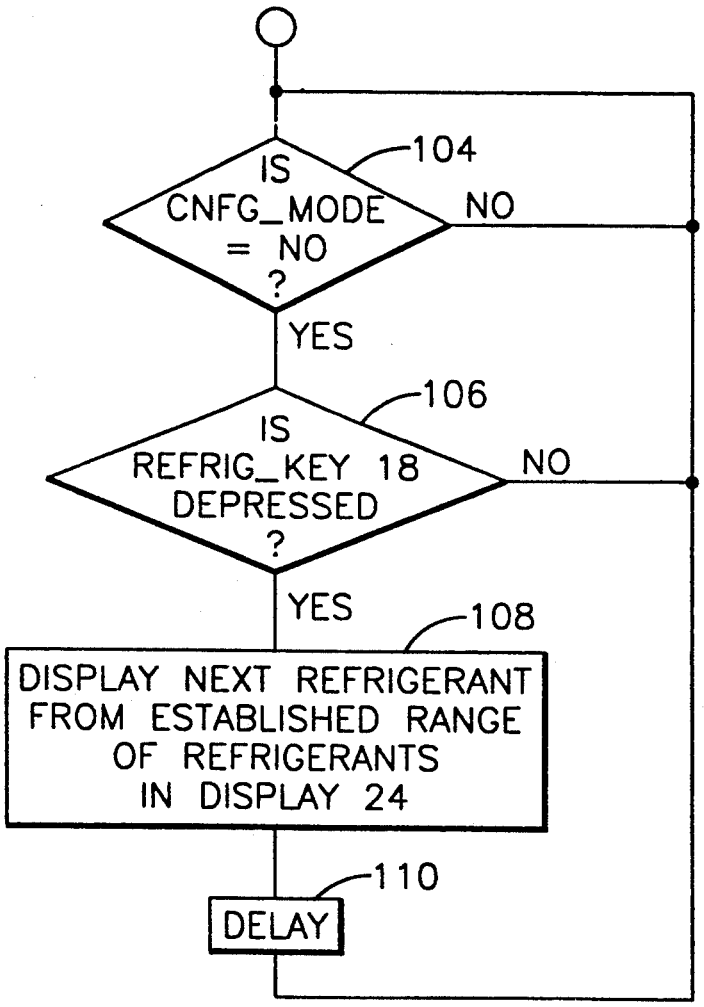
FIG. 5 illustrates how the refrigerants may be arranged within a table for recall and use during refrigerant recovery.
FIG. 6 illustrates how a refrigerant may be selected from the table of refrigerants of FIG. 5.

Referring to FIG. 5, the recallable range of refrigerants for each configuration one, two, or three is set forth. It is to be understood that the recallable range corresponding to the value of the variable CNFG read from memory 14 will be the range established by the program of FIG. 4. Each refrigerant in the established range is sequentially displayed in a program which will now be described. Referring to FIG. 5, the program within the microprocessor 12 which allows the user to select a particular refrigerant for recovery is illustrated. This program begins again with an inquiry as to whether the refrigerant configuration mode is on. If it is not, the microprocessor proceeds from step 104 to step 106 and inquires as to whether the REFRIG key 18 is being depressed. In the event that it is, the microprocessor proceeds to a step 108 and displays the next refrigerant from the established range of refrigerants. This display step essentially notes the previous refrigerant that has been displayed and displays the next refrigerant in the established range. The refrigerant is displayed in the display area 24 of the keypad/display 16. The microprocessor proceeds to implement a delay in step 110 allowing the operator or user to react to the displayed refrigerant in the display area 24. When a particular refrigerant that is desired is displayed, the refrigerant key will be released and the microprocessor will exit out of step 106. The thus selected refrigerant will be used to define the control parameters issued to the refrigerant recovery apparatus 10. The thus configured refrigerant recovery apparatus is now ready to recover the selected refrigerant.

It is to be appreciated that a process has been described for defining which of a number of ranges of refrigerants is to be used during the normal operation of the refrigerant recovery system of FIG. 1. The process for defining the particular range of refrigerants is completely separate from the normal operation of the recovery system. This would include turning the switch 28 off and then on again at some later time. The programs of FIG. 4 and 6 would merely proceed to define the range of refrigerants which may be recovered based upon the value of CNFG stored in the nonvolatile memory which is not lost during the power outage caused by turning the switch 28 off.

It is also to be appreciated that a particular embodiment of the invention has been described. Operations, modifications, and improvements thereto will readily occur to those skilled in the art. Accordingly, the forgoing description is by of example only and the invention is limited only as defined in the following claims and equivalents thereto.

What is claimed is:

1. A refrigerant recovery system including a control system that defines which refrigerants may be selected for recovery at any particular time, said control system comprising:

a display;

a programmable unit having a program including instructions for successively displaying a number of different configurations for successively displaying a number of different configurations of one or more refrigerants on said display and instructions for stopping the display of different configurations of one or more refrigerants at a particular configuration of one or more refrigerants; and a memory associated with said programmable unit for storing a representation of the particular configuration of one or more refrigerants currently being displayed for subsequent access by said programmable unit when a selection of refrigerants is to be made for refrigerant recovery.

2. The system of claim 1 wherein said memory associated with said programmable unit for storing a representation of the particular configuration of one or more refrigerants comprises:

a nonvolatile memory for storing the representation of the particular configuration of one or more refrigerants.

3. The system of claim 1 further comprising:

a keypad having at least two switches wherein said program in said programmable unit includes instructions responsive to the simultaneous depression of said two switches so as to define a configuration mode and thereafter display a configuration notice.

4. The system of claim 3 wherein said instructions for successively displaying a number of different configurations of one or more refrigerants comprises:

a set of instructions for successively displaying different configurations of one or more refrigerants when only a particular one of said two switches is depressed.

5. The system of claim 4 wherein said instructions for stopping the display of different configurations of one or more refrigerants comprises:

an instruction for stopping said means for successively displaying different configurations of one or more refrigerants when the particular one of said two switches is no longer depressed.

6. The system of claim 5 further comprising:

a third switch; and said program includes instructions for storing the representation of the particular configuration of one or more refrigerants currently displayed in said memory when said third switch is depressed.

7. The system of claim 6 wherein said memory for storing a representation of the particular configuration of one or more refrigerants when said third switch is depressed comprises:

a nonvolatile memory for storing the representation of the particular configuration of one or more refrigerants.

8. A refrigerant recovery process including a process that defines which refrigerants may be selected for recovery at any particular time comprising the steps of:

displaying successively a number of different configurations of one or more refrigerants;

stopping the successive display of different configurations of one or more refrigerants at a particular configuration of one or more refrigerants;

storing a representation of the particular configuration of one or more refrigerants currently being displayed; and accessing said stored representation of the particular configuration of one or more refrigerants when a selection of refrigerants is to be made for refrigerant recovery.

9. The process of claim 8 wherein said step of storing a representation of the particular configuration of one or more refrigerants comprises:

storing the representation of the particular configuration of one or more refrigerants in a nonvolatile memory.

10. The process of claim 8 further comprising the steps of:

sensing the simultaneous depression of two switches on a keypad;

defining a configuration mode in response to the sensing of the simultaneous depression of the two switches; and displaying a configuration notice.

11. The process of claim 10 wherein said step of successively displaying a number of different configurations of one or more refrigerants comprises the step of:

displaying different configurations of one or more refrigerants when only a particular one of said two switches is depressed.

12. The process of claim 11 wherein said step of stopping the display of different configurations of one or more refrigerants comprises the step of:

stopping said step of successively displaying different configurations of one or more refrigerants when the particular one of said two switches is no longer depressed.

13. The process of claim 12 wherein said step of storing a representation of the particular configuration of one or more refrigerants comprises:

sensing the depression of a third switch; and storing the representation of the particular configuration of one or more refrigerants currently displayed when said third switch is depressed.

14. The process of claim 13 wherein said step of storing a representation of the particular configuration of one or more refrigerants when the third switch is depressed comprises:

storing the representation of the particular configuration of one or more refrigerants in a nonvolatile memory.

15. A system for selecting a range of refrigerants that is thereafter to be used by a refrigerant recovery system in the selection of particular refrigerants to be recovered, the selection system comprising:

a display;

a programmable unit having a program including instructions for displaying a number of different ranges of refrigerants on said display;

a keypad having switches connected to said programmable unit for selecting one of the displayed ranges of refrigerants; and a nonvolatile memory connected to said programmable unit for storing a representation of the selected range of refrigerants whereby the stored representation may be subsequently recalled at anytime by the refrigerant recovery system when refrigerants are to be selected for recovery from among the selected range of refrigerants.

16. A process for selecting a range of refrigerants that is thereafter to be used by a refrigerant recovery system in the selection of particular refrigerants to be recovered, the selection process comprising the steps of:

displaying a number of different ranges of refrigerants;

selecting one of the displayed ranges of refrigerants; and storing a representation of the selected range of refrigerants in a nonvolatile memory whereby the stored representation may be subsequently recalled at anytime by the refrigerant recovery system when refrigerants are to be selected for recovery from among the selected range of one or more refrigerants.

* * * * *